US011286678B2

(12) United States Patent
Cerasi et al.

(10) Patent No.: US 11,286,678 B2
(45) Date of Patent: Mar. 29, 2022

(54) SCAFFOLDING COMPONENTS, SYSTEM AND METHOD

(71) Applicant: Sur-Loc Holdings, LLC, Kearneysville, WV (US)

(72) Inventors: Mark Cerasi, Kearneysville, WV (US); Andrew Sneeringer, Kearneysville, WV (US)

(73) Assignee: Sur-Loe Holdings, LLC, Kearneysville, WV (US)

( * ) Notice: Subject to any disclaimer, the term of this patent is extended or adjusted under 35 U.S.C. 154(b) by 220 days.

(21) Appl. No.: 16/402,366

(22) Filed: May 3, 2019

(65) Prior Publication Data

US 2019/0338540 A1 Nov. 7, 2019

Related U.S. Application Data

(60) Provisional application No. 62/666,272, filed on May 3, 2018.

(51) Int. Cl.

| | |
|---|---|
| ***E05G 5/00*** | (2006.01) |
| ***E04G 1/06*** | (2006.01) |
| ***E04G 5/00*** | (2006.01) |
| ***E04G 7/20*** | (2006.01) |

(52) U.S. Cl.
CPC ..... *E04G 1/06* (2013.01); *E04G 5/00* (2013.01); *E04G 7/20* (2013.01)

(58) Field of Classification Search
CPC ..... E04G 1/16; E04G 5/00; E04G 7/20
See application file for complete search history.

(56) References Cited

U.S. PATENT DOCUMENTS

| | | | | |
|---|---|---|---|---|
| 2,657,944 | A * | 11/1953 | Miller | F16B 7/0413 403/297 |
| 3,004,784 | A * | 10/1961 | Selby | E04G 7/20 403/19 |
| 3,628,628 | A | 12/1971 | Gilbreath et al. | |
| 3,711,133 | A * | 1/1973 | Werner | F16B 7/00 403/172 |
| 3,720,540 | A * | 3/1973 | Wimmer | C08J 7/0427 428/430 |
| 5,371,985 | A | 12/1994 | Suttles | |
| 2004/0211137 | A1 | 10/2004 | Thiede | |
| 2015/0267735 | A1* | 9/2015 | Bacon | F16B 37/045 403/298 |
| 2017/0051526 | A1 | 2/2017 | Francis | |
| 2017/0239916 | A1* | 8/2017 | Lewit | B32B 27/20 |
| 2017/0321413 | A1 | 11/2017 | Pridham | |

FOREIGN PATENT DOCUMENTS

| | | | | |
|---|---|---|---|---|
| CA | 2905680 A1 * | 3/2017 | | E04G 7/22 |
| DE | 2950742 A1 * | 6/1981 | | F16B 7/0413 |
| GB | 2339581 | 2/2000 | | |

OTHER PUBLICATIONS

International Search Report PCT/US2019/30528 (9 pages).

* cited by examiner

*Primary Examiner* — Alvin C Chin-Shue
(74) *Attorney, Agent, or Firm* — North Shore Patents, P.C.; Michele Baillie

(57) ABSTRACT

The present invention relates to a temporary support structure and scaffolding system and components, and more particularly scaffolding beams and beam connectors, that are ultra-light weight, durable and exhibit high strength.

17 Claims, 11 Drawing Sheets

SCAFFOLDING COMPONENTS, SYSTEM AND METHOD

CROSS-REFERENCE TO RELATED APPLICATIONS

This application is based on U.S. Provisional Patent Application Ser. No. 62/666,272, filed May 3, 2018, titled "Scaffolding System and Method," which application is incorporated herein by reference in its entirety and to which priority is claimed.

FIELD OF THE INVENTION

The present invention relates to temporary support structures and scaffolding systems, and more particularly support structures and systems comprising support beams and beam connectors that are ultra-light weight, durable and exhibit extremely high strength.

BACKGROUND OF THE INVENTION

Scaffolding systems provide a temporary, elevated support surface, e.g. for supporting workers and/or materials at construction sites or other projects. Various conventional scaffolding systems are known in the art, including welded frame scaffolding, system scaffolding, and tube and clamp (or twist lock) scaffolding. Various considerations must be given when erecting scaffolding, including the height and length of the scaffolding, the base on which the scaffolding rests, and the number of levels to be decked. Scaffolding components should be plumb and able to structurally support the application weight. The scaffolding system should also be readily dismantlable after completion of a project.

Generally, scaffolding systems include framing (e.g., frame tubing coupled together via brackets or pins) that form the support for walkways or platforms, and associated ties and braces (e.g., cross braces, horizontal and diagonal braces, etc.) for maintaining the strength and integrity of the system. Scaffold planking (e.g., wood, steel or aluminum planks) is then laid or clipped onto the framing. Conventionally scaffolding systems are relatively heavy and difficult to erect and dismantle. Most planking materials are particularly bulky and fail to provide for a seamless stretch of flooring given each length of plank is typically spaced in the longitudinal direction to allow for attachment to the framing. In addition, planking is sometimes prone to shifting or sliding on the underlying framing, particularly wood planking (which must therefore extend a minimum distance, e.g., 6 inches, beyond the center bearing point of the scaffold framing).

Accordingly, there is a need for an improved scaffolding system including ultra-light weight components that are durable, easy and fast to erect and dismantle, and that exhibit superior strength and integrity compared to conventional scaffolding systems.

SUMMARY OF THE INVENTION

The present invention relates to scaffolding systems, and more particularly scaffolding beams and beam connectors that are ultra-light weight, durable and exhibit high strength. In disclosed embodiments, a scaffolding system is provided which includes a framing member having a first longitudinal axis, at least a first support beam and a second support beam, and a connector. The connector comprises a first end portion securable to the first support beam, a central portion, and an opposing second end portion securable to the second support beam. The central portion comprises an indent intermediate the first and second end portions. The indent is configured to receive the framing member therein. The first support beam may be connected to the second support beam via the connector, so that the first and second support beams are aligned collinearly along a second longitudinal axis, wherein the first longitudinal axis is substantially perpendicular to the second longitudinal axis when the framing member is received in the indent of the connector.

In some embodiments, each one of the first and second beams is configured as an elongate rectangular tube. The first end portion of the connector is receivable within an opening disposed in an end of one of the tubular beams, and the second end portion of the connector is receivable within an opening disposed in an end of another tubular beam. In some implementations, the central portion of the connector comprises a raised upper region extending outwardly from the first and second end portions. Preferably, the raised upper region is substantially coplanar with an exteriorly disposed upper wall or surface of the first and/or second support beams when coupled together via the connector. In this way, the upper wall or surface of the beams and connectors onto which panels (e.g., plywood panels) are secured lie on a single plane without gaps or other depressions therebetween, which could otherwise adversely affect the structural integrity and strength of the resulting platform or walkway. In some implementations, the raised upper region has a thickness substantially equal to a thickness of a wall defining the first and/or second support beams, thus ensuring a smooth and coplanar surface between the joined beams.

In some implementations, at least one of the first end portion and/or the second end portion comprises a tapered distal end portion. The tapered end portion allows the first and/or second end portions of the connector to be easily guided and inserted into the opening in a corresponding distal end of a beam. In some implementations, at least one of the first or second support beams is releasably securable to the connector via a fastener extending through correspondingly alignable openings in the beam and the connector.

Preferably, the support beams are formed from a fiber reinforced polymer (FRP) material. As known in the art, FRP materials typically comprise a polymer matrix and reinforcing fibers. In a particularly preferred embodiment, the beam is formed from a fiberglass reinforced polyurethane material, e.g., series 4000 polyurethane fiberglass material available from Creative Pultrusions, Inc. (Alum Bank, Pa.). In some implementations, the FRP material additionally comprises one or more additives selected from the group consisting of a colorant, a lubricant, an anti-static, a heat stabilizer, an ultraviolet stabilizer, a flame retardant, a biocide, an insecticide, and/or an anti-corrosive agent.

Preferably, the connector is formed from a high strength polymer material comprising nylon, high density polyethylene (HDPE), polybutylene terephthalate (PBT), high glass acrylonitrile butadiene styrene (ABS), and/or polycarbonate (PC). In some implementations, the high strength polymer material may comprise a polymer matrix and reinforcing fibers. In a particularly preferred embodiment, the connector is formed from fiberglass and nylon reinforced polymer composite material. A suitable fiberglass and nylon reinforced composite is available from AMCO Polymers (Orlando, Fla.), e.g., HYLON® Polyamide 66 including 13% reinforcing glass fibers. In some implementations, the high strength polymer material comprises one or more additives selected from the group consisting of a colorant, a lubricant, an anti-static, a heat stabilizer, an ultraviolet stabilizer, a flame retardant, a biocide, an insecticide, and/or an anti-corrosive agent.

In some embodiments, the connector has a generally U-shaped configuration in cross-section. In some implementations, the connector comprises a plurality of support struts extending between interiorly disposed surfaces of opposing sides thereof. As would be readily understood in the art, the support struts substantially increase structural integrity of the connector. In some embodiments, the first end portion of the connector comprises a first recess defined by a base and spaced sides extending outwardly from the base. The second end portion of the connector comprises a second recess defined by a base and spaced sidewalls extending outwardly from the base. An end of the first support beam is received and securable within the first recess, and an end of the second support beam is received and securable within the second recess. In some implementations, the central portion comprises a divider wall partially defining the indent in the connector.

The present invention also relates to a temporary platform structure or walkway comprising: a plurality of spaced framing rails extending parallel to a first longitudinal axis and disposed on a first plane; a plurality of connectors spaced along and releasably coupled to each of the framing rails; and a plurality of spaced tubular beams extending between the framing rails and coupled thereto via the connectors. Each of the connectors comprises opposing end portions, and a central portion intermediate the end portions and comprising an indent. A corresponding framing member or rail is received in the indent. Each of the beams comprises a first end coupled to and disposed around an end portion of one of the connectors, and a second end coupled to and disposed around an end portion of another of the connectors (wherein end portions of the connector are inserted into and secured within openings or cavities of separate beams). The beams extend perpendicularly relative to the first longitudinal axis and have upper surfaces disposed on a second plane spaced from and parallel to the first plane. A plurality of panels are coupled to and supported by the tubular beams, thereby forming a temporary support structure.

DETAILED DESCRIPTION OF EMBODIMENTS OF THE INVENTION

Figure 1:
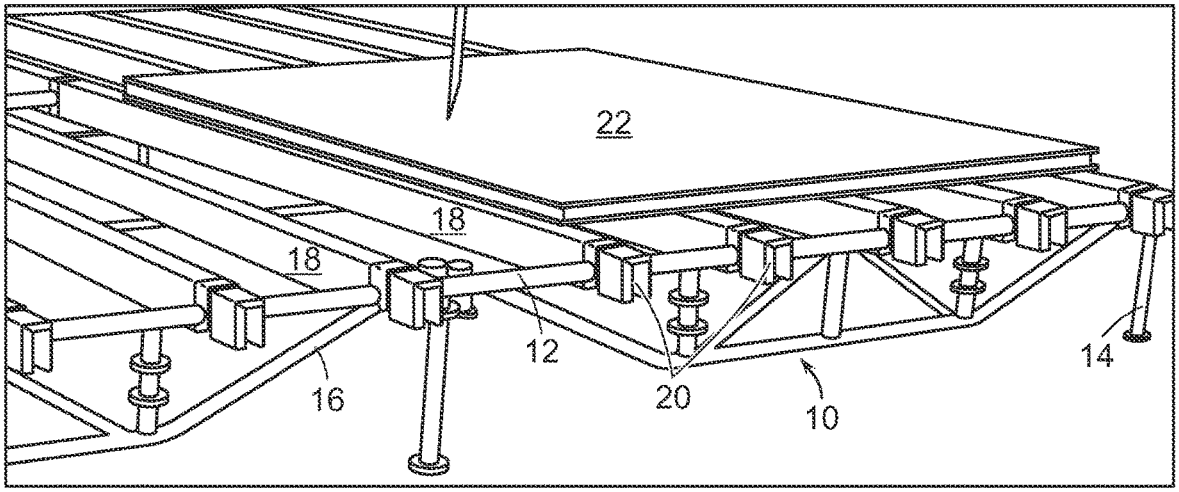
FIG. 1 is a perspective view of a scaffolding system and platform structure in accordance with the present invention.
Figure 2:
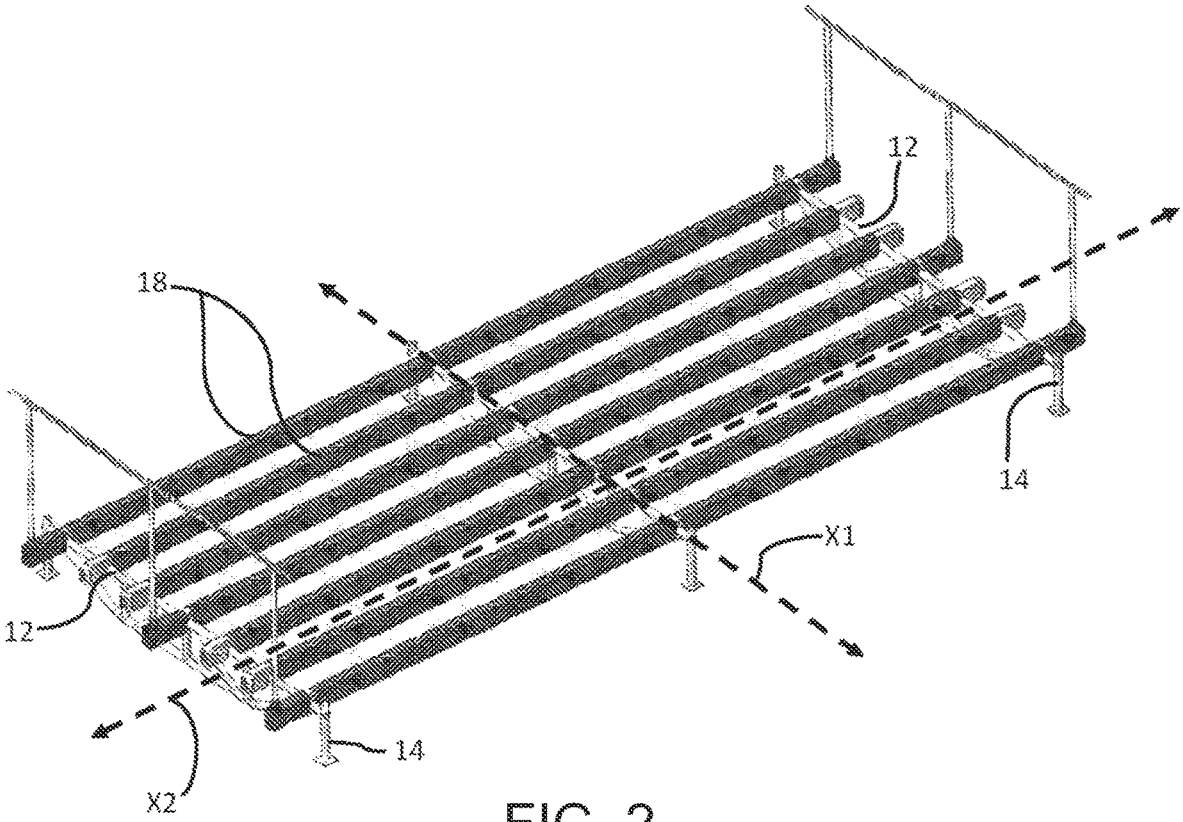
FIG. 2 is a perspective view of the scaffolding system showing framing members and support beams secured thereto via connectors.
Figure 3:
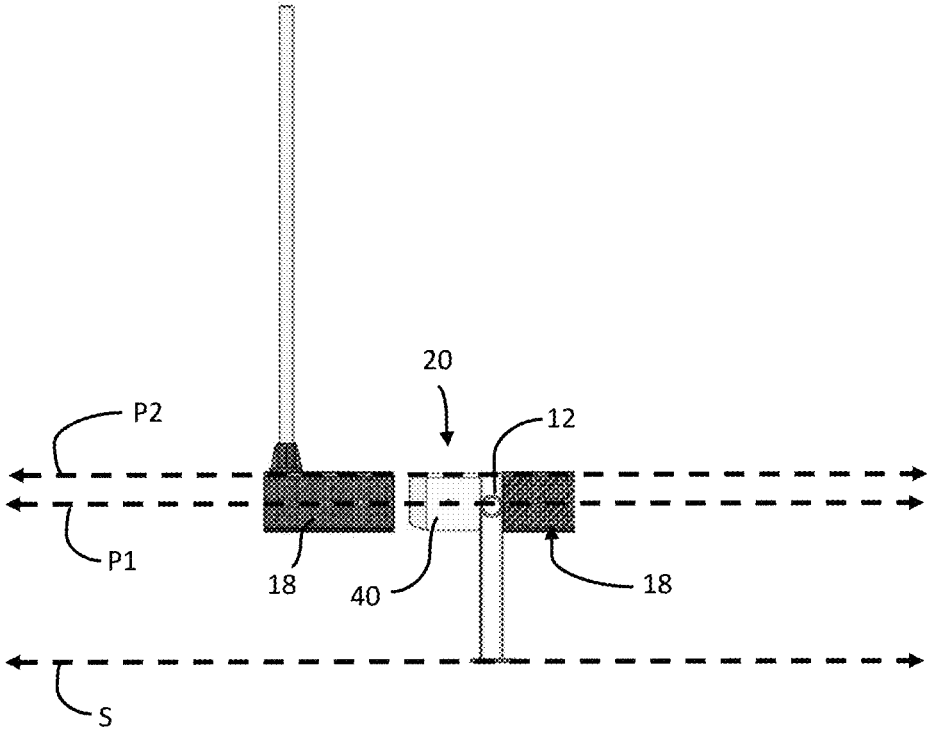
FIG. 3 is a front elevational view of the scaffolding system showing portions of beams being joined via the connector disposed on an upper rail of the framing members.

The present invention is directed to scaffolding beams and beam connectors for a scaffolding system, and a temporary platform structure comprising the scaffolding beams and beam connectors in accordance with disclosed embodiments. Referring to FIGS. 1 and 2, a scaffolding system includes a plurality of framing members 10 which may be configured and arranged to provide a plurality of upper framing rails 12 supported by legs 14 and cross braces 16. As shown in FIGS. 2 and 3, the rails 12 are disposed on a plane P1 (FIG. 3) elevated from a support surface S, and extend parallel to each other and parallel to a longitudinal axis X1 thereof (FIG. 2).

Figure 4:
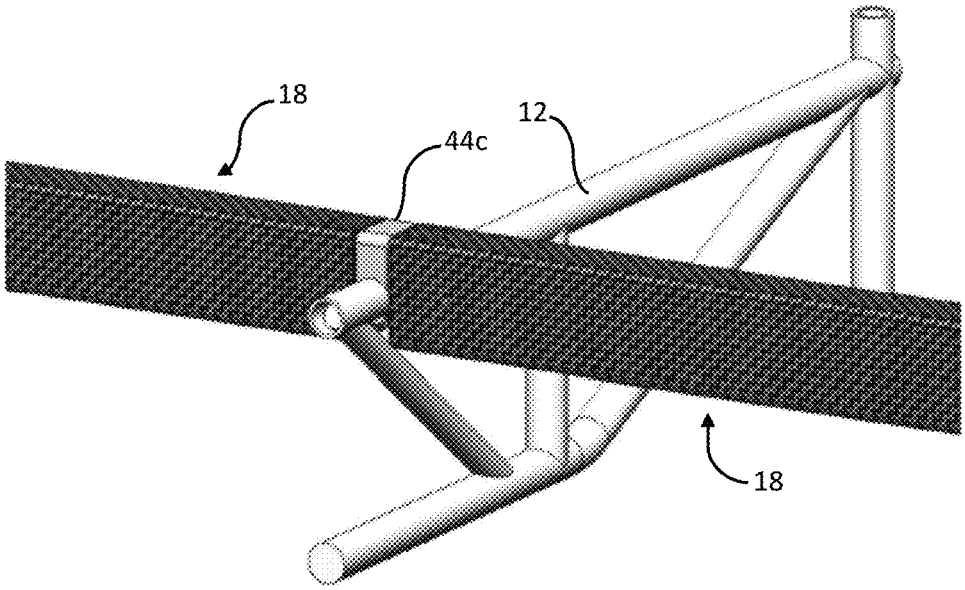
FIG. 4 is a perspective view of the scaffolding system showing portions of beams joined via a connector positioned on the upper rail of the framing members.
Figure 5:
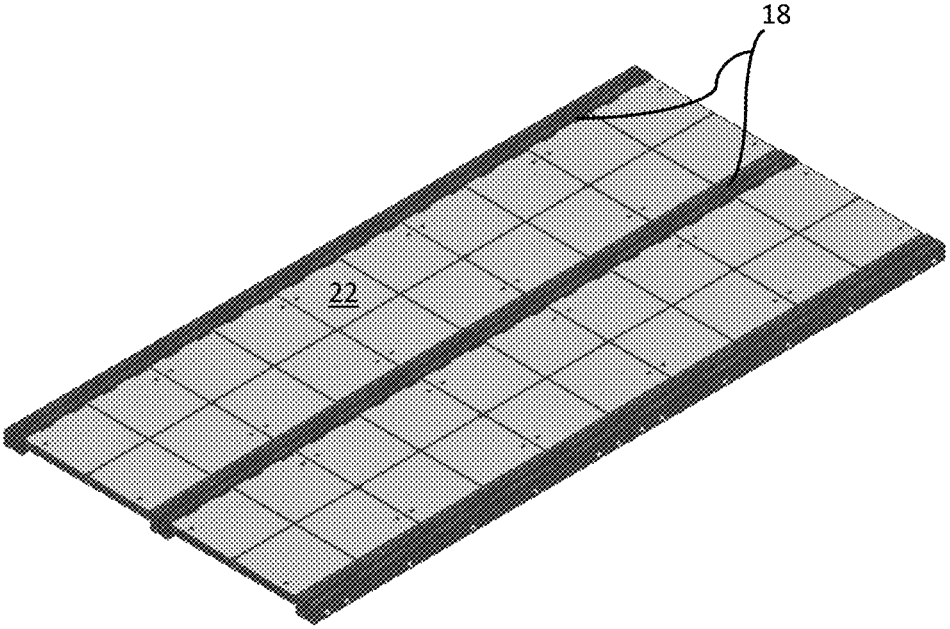
FIG. 5 is a perspective view of support beams with panels secured thereto.

A plurality of trusses or support beams 18 extend between adjacent rails 12. The beams 18 extend parallel to each other and parallel to a longitudinal axis X2 thereof (FIG. 2). Axis X2 is substantially perpendicular to axis X1, thus rails 12 and beams 18 form a grid. Each beam 18 may be coupled to adjacent rails 12 via connectors 20, as shown in FIGS. 3 and 4. Two or more beams 18 may be collinearly aligned and coupled together via connector(s) 20, wherein the upper surfaces of the joined beams 18 and connectors 20 form a smooth support surface (e.g., for attaching planks or panels 22 thereto) and lie on the same plane P2 (FIG. 3). Plane P2 is therefore spaced from and parallel to plane P1 on which rails 12 are disposed. The beams 18, when secured to the rails 12 of framing members 10 via connectors 20, form an extremely stable scaffolding system. A plurality of panels 22 may be secured directly to the upper surfaces of the beams 18 (e.g., via screws, nails or other fasteners) to form a platform or walkway structure (FIG. 1). If necessary and/or desired, two or more beams 18 may be coupled together along their longitudinal axis for increased strength, as shown in FIG. 5. In addition, numerous beams 18, e.g., 3, 4, 6, 8, 10, 12, 15, 20 or more, many be readily coupled together via connectors 20 to form a truss assembly extending collinearly for a desired length and having a smooth and coplanar upper surface (e.g., onto which panels 22 may be secured).

Preferably, the beams 18 are formed from a light-weight and high strength polymer material. Preferably, the beams 18 are formed from a fiber reinforced polymer material (FRP). As known in the art, suitable FRP composite materials include a polymer matrix such as a thermoset resin (e.g., polyester, vinyl ester, polyurethane, epoxy) and one or more reinforcing fiber materials (e.g., fiberglass, carbon, aramid, basalt, aramid, wood, wood composite, etc.). In some implementations, the FRP composite material utilized to form the beams 18 includes one or more additives that enhance appearance, strength and/or protection. Suitable additives include a colorant, a lubricant, an anti-static, a heat stabilizer, an ultraviolet stabilizer, a flame retardant, a biocide, an insecticide, and/or an anti-corrosive agent. In some implementations, the FRP composite material utilized to form the beams 18 includes other fillers or additives, e.g., including inorganic and organic fillers. Various fillers are well known in the polymer lumber industry. Inorganic fillers include, e.g., talc, mica, silica, wollastonite, calcium carbonate, etc. Organic fillers include, e.g., cellulosic materials such as wood flour, flax skive, rice hulls, wheat straw, etc. The specific mixtures of polymer, reinforcing fibers, additives and fillers are known in the art and depend on desired structural and functional characteristics for the resulting beams.

Beams 18 and other components formed from FRP composite materials exhibit substantial advantages over correspondingly configured conventional wood components, e.g., as outlined in Table 1 below:

TABLE 1

FRP to Timber Comparison

| Material | Fiberglass Reinforced Polymer (FRP) | Structural Timber |
|---|---|---|
| Corrosion Resistance | Superior resistance to a broad range of chemicals. Unaffected by moisture or immersion in water. UV additives create excellent weatherability. | Can warp, rot and decay from exposure to moisture, water and chemicals. Coatings or preservatives required to increase corrosion or rot resistance can create hazardous waste and/or high maintenance. |
| Insect Resistance | Unaffected by insects. | Susceptible to insect attack (marine borers, termites, etc.). Coatings to increase resistance to insects can be environmentally hazardous. |
| Electrical Conductivity | Non-conductive - high dielectric capability. | Timber can be conductive when it is wet. |
| Weight | Specific Gravity = 1.7<br>FRP has significantly higher strength-to-weight ratio.<br>Weight: 25 lbs - 10 ft length | Specific gravity 0.48<br>Specific Gravity = 0.51 (oven dried)<br>60-80 lbs. - 10 ft length |
| Finishing and Color | Pigments added to the resin provide color throughout the part. Special colors available. Composite design can be customized for required finishes. | Must be primed and painted for colors. To maintain color, repainting is typically required |
| Additives | Flame Retardancy<br>Antistatic Properties<br>Grip Additives | Kiln Dried<br>Pressure Treated |
| Temperature Range | −10 to 110 Deg. F. | |

In a preferred embodiment, the FRP beam 18 is formed via a pultrusion process. In one implementation, the beam 18 is pultruded using a braided fiberglass-reinforced polyurethane material. A suitable braided fiberglass-reinforced polyurethane material is available from Creative Pultrusions, Inc. (Alum Bank, Pa.). Deflection testing results for beams (117.5 inch length) are provided below:

TABLE 2

Deflection Comparison (Live load of 100 psf)

| Composite (w/plywood) | Joist Spacing (in. O.C.) | Deflection (in.) | Deflection (Fraction) |
|---|---|---|---|
| Yes | 12 | 0.19 | L/628 |
| Yes | 16 | 0.23 | L/507 |
| Yes | 24 | 0.33 | L/377 |
| No | 12 | 0.27 | L/437 |
| No | 16 | 0.36 | L/327 |
| No | 24 | 0.54 | L/219 |

1. Determined Based on a live load of 100 lbs/ft$^2$ (psf);

2. Composite beam is based on ¾ inch layer of plywood acting compositely with the beam.

3. Deflection based on modulus of elasticity (MOE) of 5800 thousand pounds per square inch (KSI) provided by manufacturer

TABLE 3

| Deflection Comparison (Live load of 125 psf) | | | |
|---|---|---|---|
| Composite (w/plywood) | Joist Spacing (in. O.C.) | Deflection (in.) | Deflection (Fraction) |
| Yes | 12 | 0.235 | L/503 |
| Yes | 16 | 0.29 | L/405 |
| Yes | 24 | 0.39 | L/301 |
| No | 12 | 0.34 | L/350 |
| No | 16 | 0.45 | L/262 |
| No | 24 | 0.675 | L/175 |

1. Determined Based on a live load of 125 psf;
2. Composite beam is based on ¾ inch layer of plywood acting compositely with the beam.
3. Deflection based on modulus of elasticity (MOE) of 5800 thousand pounds per square inch (KSI) provided by manufacturer

TABLE 4

| Deflection comparison (Live load 150 psf) | | | |
|---|---|---|---|
| Composite (w/plywood) | Joist Spacing (in. O.C.) | Deflection (in.) | Deflection (Fraction) |
| Yes | 12 | 0.28 | L/419 |
| Yes | 16 | 0.35 | L/338 |
| Yes | 24 | 0.47 | L/251 |
| No | 12 | 0.41 | L/291 |
| No | 16 | 0.54 | L/219 |
| No | 24 | 0.81 | L/146 |

1. Determined Based on a live load of 150 psf;
2. Composite beam is based on ¾ inch layer of plywood acting compositely with the beam.
3. Deflection based on modulus of elasticity (MOE) of 5800 KSI provided by manufacturer Beams at joist spacing shown above are adequate to easily support 100 psf live load in addition to sheathing and beam self weight with a minimum factor of safety of 5:1 (bending) and 7:1 (shear). Beams requiring a 150 psf rating have a minimum factor of safety of 4:1 (bending) and 3:1 (shear).

Figure 6:
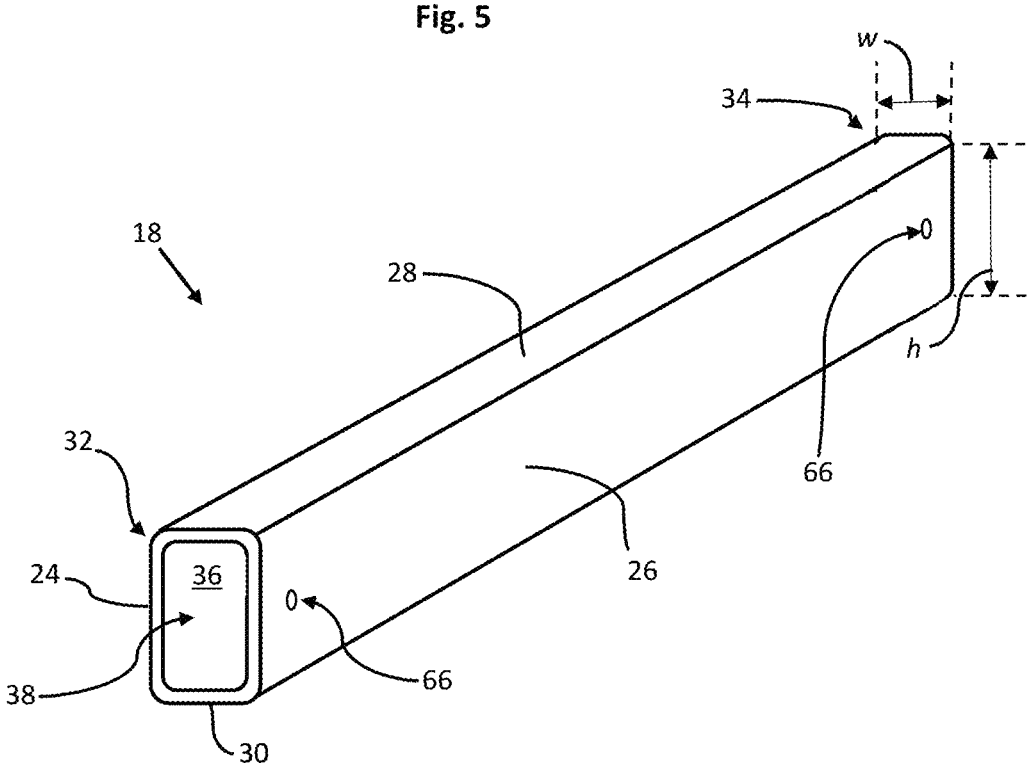
FIG. 6 is a perspective view of a support beam in accordance with disclosed embodiments.

Referring to FIG. 6, support beam 18 preferably has a generally elongate rectangular and tubular configuration. The beam 18 includes opposing side walls 24, 26, an upper wall 28 and a lower wall 30. Walls 24, 26, 28, 30 extend between opposing distal ends 32, 34 of the beam 18, and define an internal space or cavity 36. An opening 38 is disposed in or defined by the distal end 32, and another opening is disposed in or defined by the opposite and similarly configured distal end 34.

The walls 24, 26, 28, 30 are sufficiently thick to maintain structural integrity of the beam 18 for the desired application (see Tables 2-4). Thus, the thickness of the walls 24, 26, 28, 30 is dependent in part upon the particular material composition and/or the desired application and required strength of the beam 18. In a preferred embodiment, the walls 24, 26, 28, 30 of beam 18 have a thickness or caliper of between about 0.10 inch and about 0.50 inch, more preferably between about 0.10 inch and about 0.25 inch. In one embodiment, the thickness of the side walls 24, 26 is between about 0.125 and about 0.35 inch, preferably about 0.125 inch. In one embodiment, the thickness of upper and lower walls 28, 30 is uniform with the thickness of the side walls 24, 26. In another embodiment, the thickness of the upper and lower walls 28, 30 is different from that of the side walls 24, 26, e.g., having a thickness of between about 0.125 and about 0.35 inch. In some embodiments, the thickness or caliper of the upper and lower walls 28, 30 is at least about 20% greater than the caliper of the side walls 24, 26, or about 25% greater than the caliper of the side walls 24, 26, or about 40% greater than the caliper of the side walls 24, 26, or about 50% greater than the caliper of the side walls 24, 26, or about 75% greater than the caliper of the side walls 24, 26, or at least twice the caliper of the side walls 24, 26. In a particularly preferred embodiment, the thickness of the side walls 24, 26 is about 0.125 inch and the thickness of the upper and lower walls 28, 30 is 0.225 inch.

Each beam 18 may have virtually any desired length, e.g. 4, 6, 8, 9, 10, 12, 14, 16, 18, 20 feet or more, as appropriate for the material composition utilized, component dimensions, and application (see Table 5 below). Similarly, height (h) and width (w) of the beam 18 (FIG. 6) may vary as determined in part by material composition, component dimensions, and application. For example, each beam 18 preferably has a width of between about 2 inch and about 8 inch, and a height of between about 4 inch and about 8 inch. In a particularly preferred embodiment, each beam 18 has a width of about 3.5 inch and a height of about 5.5 inch.

TABLE 5

| Beam Span | | | |
|---|---|---|---|
| Span (feet) | Allowable load, local compression buckling capacity, 2.5x Safety Factor (lbs/ft) | Allowable load, flexural capacity, 2.5x Safety Factor (lbs/ft) | Allowable load, in-plane shear of web capacity, 3x Safety Factor (lbs/ft) |
| 8 | 282 | 1609 | 802 |
| 9 | 223 | 1271 | 713 |
| 10 | 181 | 1030 | 642 |
| 11 | 149 | 851 | 583 |
| 12 | 125 | 715 | 535 |
| 13 | 107 | 609 | 494 |
| 14 | 92 | 525 | 458 |
| 15 | 80 | 458 | 428 |
| 16 | 71 | 402 | 401 |
| 17 | 63 | 356 | 377 |
| 18 | 56 | 318 | 356 |
| 19 | 50 | 285 | 338 |
| 20 | 45 | 257 | 321 |

Referring again to FIGS. 3 and 4, two beams 18 may be readily aligned longitudinally and coupled together via the connector 20, thereby forming a continuous truss component formed from two (or more) beams 18, wherein the upwardly disposed surfaces of the connector 20 and beams 18 are coplanar (plane P2).

Figure 12:
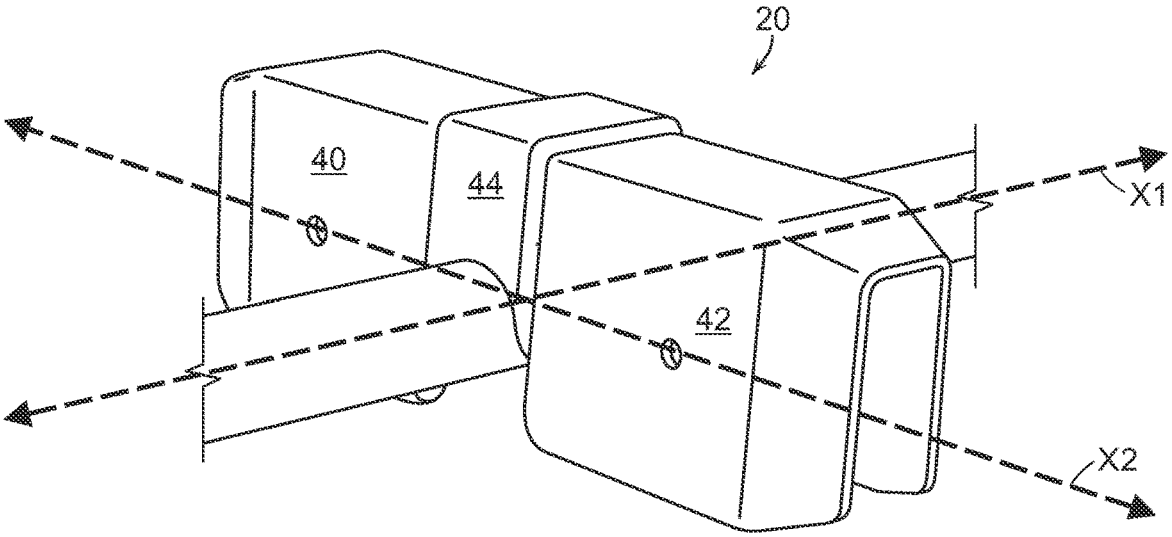
FIG. 12 is a perspective view of a connector disposed on the framing member, and showing portions of the upper rail received in a space or indent of the connector.
Figure 13:
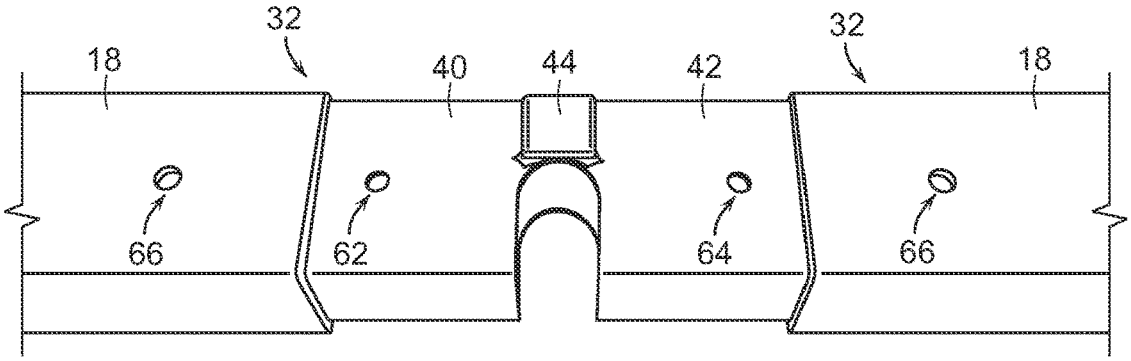
FIG. 13 is a perspective view showing portions of beams being joined by a connector.

A preferred embodiment of the connector 20 is illustrated in FIGS. 7-13. Connector 20 includes a first end portion 40 securable to a distal end 32 (or 34) of a first beam 18, and an opposite second end portion 42 securable to a distal end 32 (or 34) of another or second beam 18 (FIG. 13). Connector 20 includes a central portion 44 intermediate the first and second end portions 40, 42 and having an upper portion 46 and a lower portion 48. The lower portion 48 includes or defines an indent 50 defining a generally saddle-shaped opening or gap extending between opposing first and second sides 52, 54 thereof. Indent 50 is configured to receive an upper rail 12 of framing member 10 (FIG. 12), so that the central portion 44 straddles the upper rail 12. The first and second end portions 40, 42 extend outwardly from the upper rail 12 in opposing directions and away from the upper rail 12 (FIG. 12). In particular, the rail 12 extends along or parallel to longitudinal axis X1, and the first and second end portions 40, 42 extend outwardly from the central portion 44 thereof in directions along or parallel to longitudinal axis X2. Thus, the longitudinal axis of rails 12 is perpendicular to the longitudinal axis of connector 20.

Preferably, the connector 20 is formed from a high strength polymer material, for example including but not limited to a nylon composite, high-density polyethylene (HDPE), polybutylene terephthalate (PBT), high glass acrylonitrile butadiene styrene (ABS), and/or polycarbonate (PC). In some implementations, the connector 20 is formed from a high strength polymer material comprising a polymer matrix and reinforcing fibers (e.g., as described above). In a particularly preferred embodiment, the connector is formed from a fiberglass and nylon reinforced polymer composite material. A suitable fiberglass and nylon reinforced polymer composite is available from AMCO Polymers (Orlando, Fla.), e.g., HYLON® Polyamide 66 including 13% reinforcing glass fibers. The high strength polymer material preferably comprises one or more additives. Suitable additives include a colorant, a lubricant, an anti-static, a heat stabilizer, an ultraviolet stabilizer, a flame retardant, a biocide, an insecticide, and/or an anti-corrosive agent. In some implementations, the polymer material utilized to form the connectors 20 includes other fillers or additives, e.g., including inorganic and organic fillers as described above.

An exemplary connector 20 formed in accordance with disclosed embodiments was shaped using a mold. The plastics used to form the connector 20 comprised HYLON® N1043HL (Polyamide 66). The load test consisted of dead hanging (4) blocks weighing between 2020 lbs and 2190 lbs. Weights were connected approximately 41 inch from the end-span of the beam. The loading of the beam and connector reflect a min. 2:1 factor of safety (FOS) versus anticipated bending produced by a 150 psf live load with beams spaced 24" on center (OC).

Figure 7:
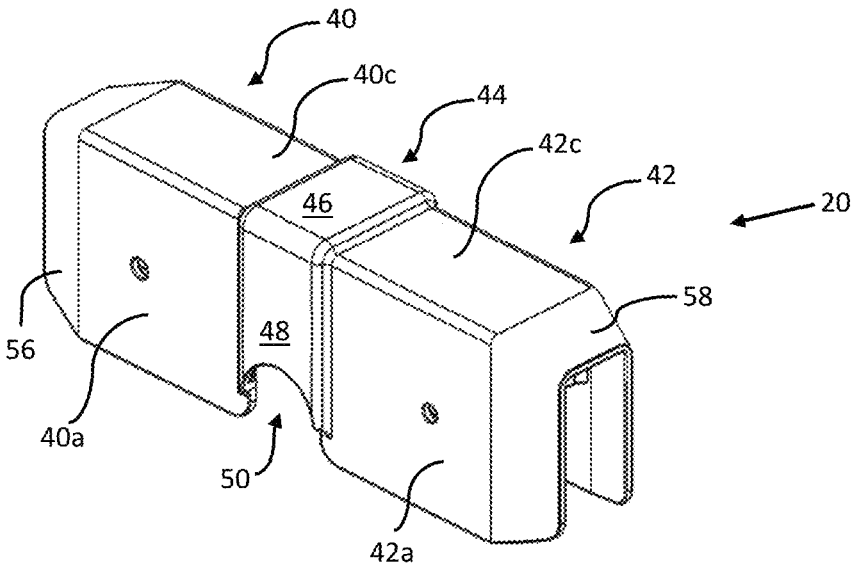
FIG. 7 is a perspective view of a connector in accordance with disclosed embodiments.
Figure 8:
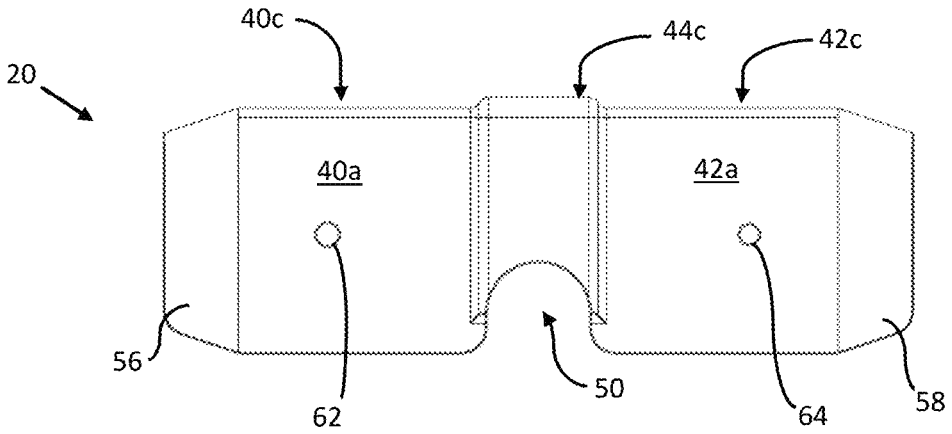
FIG. 8 is a front elevational view of the connector of FIG. 7.
Figure 9:
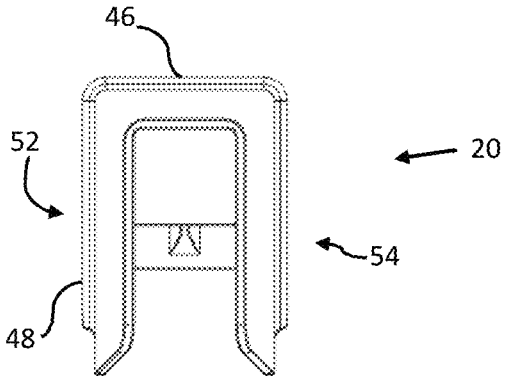
FIG. 9 is a side elevational view of the connector of FIG. 7.
Figure 10:
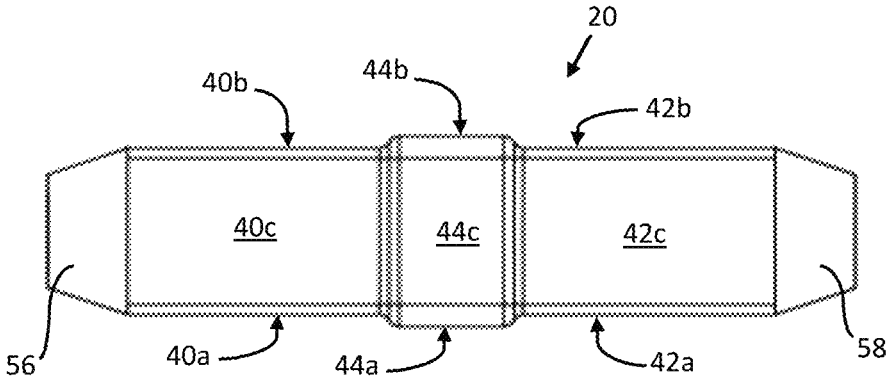
FIG. 10 is a top view of the connector of FIG. 7
Figure 11:
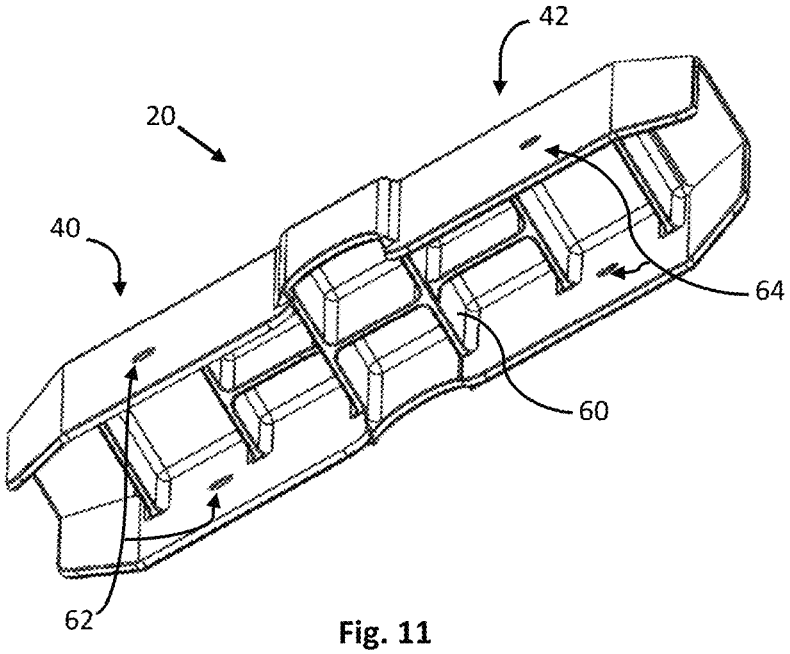
FIG. 11 is a bottom perspective view of the connector of FIG. 7.

The connector 20 has a generally U-shaped configuration in cross-section (see FIGS. 7 and 9). The first and second end portions 40, 42 each include opposing sides 40*a*, 40*b* and 42*a*, 42*b*, respectively, and top walls 40*c* and 42*c*, respectively (FIG. 10). As shown FIG. 11, the connector 20 preferably includes webbing comprising a plurality of support struts 60 extending between and connected to internally disposed surfaces of opposing sides 40*a*, 40*b* and/or top wall 40*c*, and between internally disposed surfaces of opposing sides 42*a*, 42*b* and/or top wall 42*c*. The support struts 60 extend outwardly and away from the top walls 40*c* and/or 42*c* a distance of about ¼ to about ½ or more of the total height of the connector 20. Additional support struts 60 may be provided proximate or extending through the internally disposed space defined by the central portion 44 of the connector 20 (FIG. 11) However, struts 60 should not extend into or otherwise block the indent 50 (FIG. 8).

In some implementations, the central portion 44 of connector 20 includes a raised upper region 44*c* (FIGS. 8 and 10) that extends outwardly relative to the top walls 40*c*, 42*c* of the first and second end portions 40, 42, respectively. Preferably, the upper region 44*c* of the central portion 44 extends outwardly and/or has a thickness substantially equal to the thickness of the walls 24, 26, 28, 30 of beam 18. In this way, the exteriorly and upwardly disposed surfaces of the upper region 44*c* of the connector 20 and the top wall 40*c*, 42*c* of beam(s) 18 are coplanar on plane P2 (FIGS. 3 and 14) when the first and second end portions 40, 42 are received in openings 38 of the distal ends 32 (and/or 34) of joined beams 18. Thus, the height or caliper of upper region 44*c* (relative to top walls 40*c*, 42*c*) accounts for and corresponds to the thickness of wall 30 of beam 18. The first end portion 40 preferably includes a tapered distal end portion 56, and the second end portion 42 also preferably includes a tapered distal end portion 58 (FIGS. 7, 8 10).

The specific dimensions of the connector 20 may vary depending on the particular dimensions utilized for beam 18, as well as the particular material composition of the connector 20. Thus overall height, width and wall thickness of the connector 20 will depend in part on its material composition, beam 18 dimensions, and the desired application and strength requirements. Each of the first and second end portions 40, 42 has a height and width corresponding to the height and width of the opening 38 adjacent cavity 36 of beam 18. For example, the first and second end portions 40, 42 may have a height of between about 3.5 inch and about 7.5 inch. In a particularly preferred embodiment, each of the first and second end portions 40, 42 of connector 20 has a width of about 3.10 inch and a height of about 4.90 inch. The length of each of the first and second end portions 40, 42 may likewise vary, e.g., between about 4 inch and about 8 inch, more preferably between about 5 inch and about 7 inch. In one embodiment, each of the first and second end portions 40, 42 has a length (i.e., the distance from the central portion 44 to the outermost edge of the corresponding tapered distal end portion) of about 6.5 inch. The central portion 44 preferably has a width and height of the first and second side portions 40, 42 in order to account for the thickness of wall 24, 26, 28 and/or 30 of beam 18. For example, the height and width of the central portion 44 preferably corresponds to the overall height and width of the beam 18. In a particularly preferred embodiment, the central portion 44 has a width (i.e., the distance between raised side surfaces 44*a*, 44*b*) of about 3.5 inch, and a height or thickness of the upper region 44*c* extending upwardly from of the top walls 40*c*, 42*c* of the first and second end portions 40, 42 a distance corresponding to the thickness or caliper of the upper wall 28 of beam 18 (e.g., between about 0.10 inch and about 0.50 inch, more preferably between about 0.10 inch and about 0.25 inch, preferably about 0.22 inch). The length of the central portion 44 (i.e., the length spanning between and interconnecting the first and second end portions 40, 42) may vary, e.g., between about 2 inch and about 4 inch, preferably between about 2 inch and about 3 inch. In one embodiment the length of the central portion 44 is about 2.4 inch. In one embodiment, the overall length of the connector 20 is about 15 inch.

The thickness or caliper of the sides, walls and struts of the connector 20 are sufficiently thick to maintain structural integrity thereof for the desired application. Thus, the caliper or thickness of the sides, walls and struts of connector 20 depend in part upon the particular material composition and/or the desired application and required strength, as would be readily understood by one of skill in the art. In a preferred embodiment, sides 40*a*, 40*b*, 42*a*, 42*b* and/or top walls 40*c*, 42*c* have a thickness or caliper of between about 0.10 inch and about 0.5 inch, more preferably between about 0.1 inch and about 0.25 inch, or about 0.125 inch.

Figure 14:
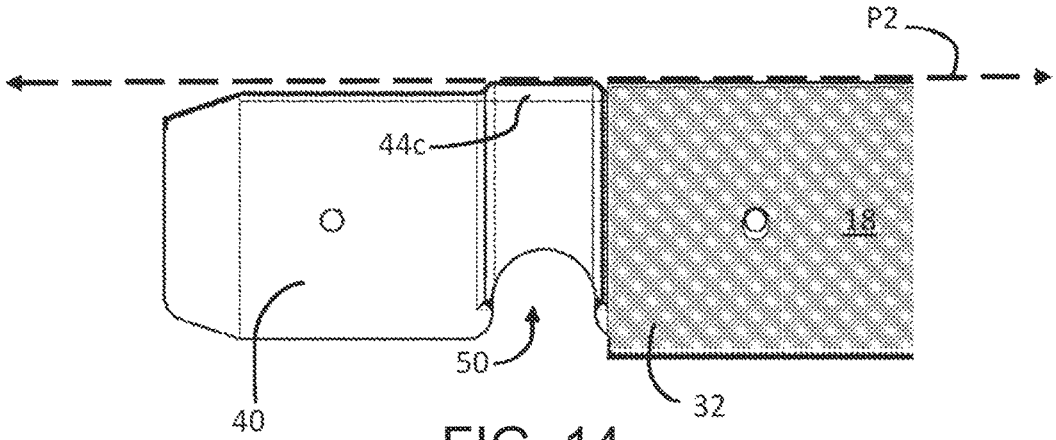
FIG. 14 is a front elevational view of a connector and showing a portion of a beam coupled to an end portion of the connector.

Referring to FIGS. 13 and 14, the first end portion 40 of the connector 20 is receivable within the opening 38 of the distal end 32 (or 34) of a first beam 18, and the second end portion 42 is receivable within the opening 38 of the distal end 32 (or 34) of another or second beam 18. The tapered distal end portions 56, 58 of first and second end portions 40, 42 of the connector 20 allow the corresponding openings 38 of the beams 18 to be easily aligned with and slide over the end portions 40, 42, of the connector 20, given the tapered distal end portions 56, 58 have dimensions (width and height) less than the corresponding dimensions (width and height) of the openings 38 in beam 18 (when viewed in cross section). Thus, the angled surface of tapered end portions 56, 58 act as guide surfaces, wherein the walls 24, 26, 28, 30 adjacent opening 38 of beam 18 slide against the tapered end portions 56, 58 and into proper position for mating the beam(s) 18 with connector 20.

After the first and/or second end portions 40, 42 are received within corresponding openings 38 of first and second beams 18 (see FIGS. 4 and 14), the beams 18 are releasably secured to the connector 20, e.g. such as with pins, bolts, screws or other fasteners. In some implementations, the connector 20 includes aligned holes 62 extending through opposing sides 40*a*, 40*b*, and aligned holes 64 extending through opposing sides 42*a*, 42*b* (see FIGS. 8 and 11). Similarly, the walls 24, 26 of beam 18 each include holes 66 proximate distal ends 32, 34 thereof (see FIG. 13). A fastener (e.g., pins, bolts, screws, etc.) passes through the aligned holes 62 (or 64) and 66, thereby releasably securing the joined connector 20 and beams 18.

Figure 15:
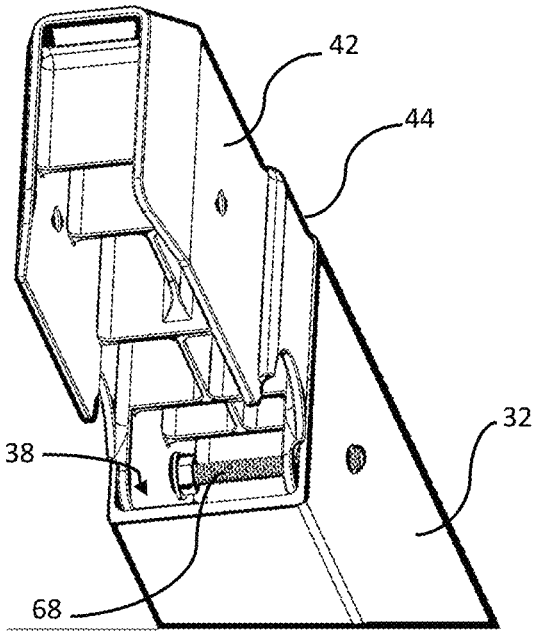
FIG. 15 is a bottom perspective view showing a portion of a beam coupled to a connector in accordance with disclosed embodiments.
Figure 16:
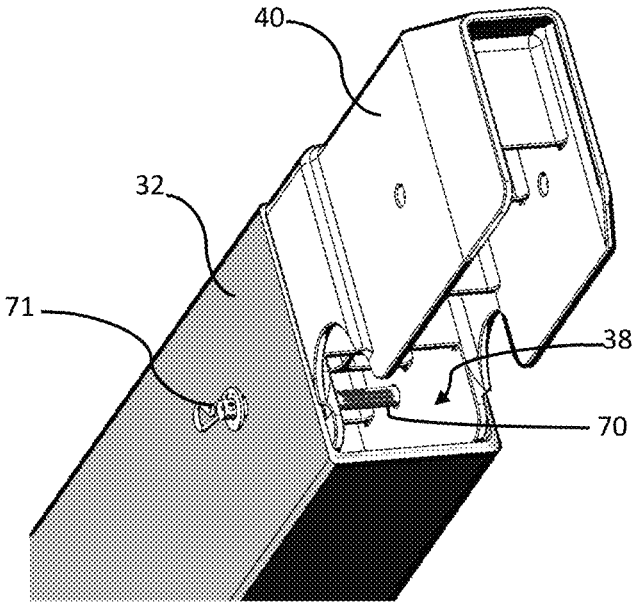
FIG. 16 is another bottom perspective view showing a portion of a beam coupled to a connector via a quick-release pin.

In one implementation, the first end portion 40 of the connector 20 is inserted into and secured within an opening 38 in the distal end 32 (or 34) of the beam 18 via a threaded bolt 68 and internally disposed nuts, as shown in FIG. 15. In this way, the connector 20 is removable from the beam 18 only by loosening the nuts and removing the bolt 68. After disassembly of the scaffolding system, one or more of the beams 18 may be maintained with a connector 20 remaining secured to one distal end 32 (or 34) thereof. Upon re-use and reassembly of the scaffolding system, the beam 18 with one connector 20 already joined thereto may be rapidly joined with another beam 18 (as described above). In particular, the second end portion 42 of the connector 20 is inserted into and secured within an opening 38 of a second beam 18 via a pin 70. The pin 70 slides through the aligned holes 62 (or 64) of the connector 20 as well as holes 66 disposed in opposing sides 24, 26 of beam 18. A flange at one end thereof maintains the pin 70 in position against one of sides 24, 26 of the beam 18, and the opposite end of the pin 70 is retained in position via a clip 71 adjacent the opposite side 24, 26 of the beam 18 (FIG. 16). Thus, the speed and ease of assembly and disassembly of the beams 18 and connectors 20, and thus the scaffolding system, is greatly enhanced.

As described above, the central portion 44 of the connector 20 preferably has a thickness substantially equal to the thickness of walls 24, 26, 28, 30 of the beam 18. In particular, the raised upper region 44*c* of the central portion 44 preferably has a thickness substantially equal to the upper wall 28 of the beam 18. Beams 18 slide over first and second end portions 40, 42 of connector 20, until the distal ends 32 (or 34) of the aligned beams 18 abut the central portion 44, including the raised upper region 44*c* (FIG. 14). The upper region 44*c* of the central portion 44 is substantially coplanar with the exteriorly disposed surface of the upper wall 28 of each of the joined beams 18 when the connector 20 is received within and secured to the aligned beams 18 (FIGS. 3, 4 and 14). Raised side surfaces 44*a*, 44*b* of the central portion 44 (FIG. 10) are likewise preferably coplanar with the exteriorly disposed surfaces of side walls 24, 26 of the beam 18 when the first and/or second end portion 40, 42 of the connector 20 is received within the opening 38 and coupled to the beam 18. The raised side surfaces 44*a*, 44*b* also act as stops against which the distal end 32 (or 34) of the beam 18 abuts when fully coupled to the connector 20.

In accordance with disclosed embodiments, a temporary walkway and/or other platform structure may be rapidly assembled and disassembled. Thus, a platform structure in accordance with the present invention includes a plurality of connectors 20, which are spaced along and releasably coupled to upper rails 12 of framing rails 10 as described above. A plurality of tubular trusses or beams 18 extend between the rails 12, with a first distal end thereof 32 coupled to an end portion 40 (or 42) of one of the connectors 18, and a second distal end thereof 34 coupled to an end portion 40 (or 42) of another of the connectors 18. The connectors 20 and beams 18 extend along or are parallel to axis X2, which is perpendicular to the longitudinal axis X1 of the upper rails 12 (FIGS. 2 and 12).

Figure 17:
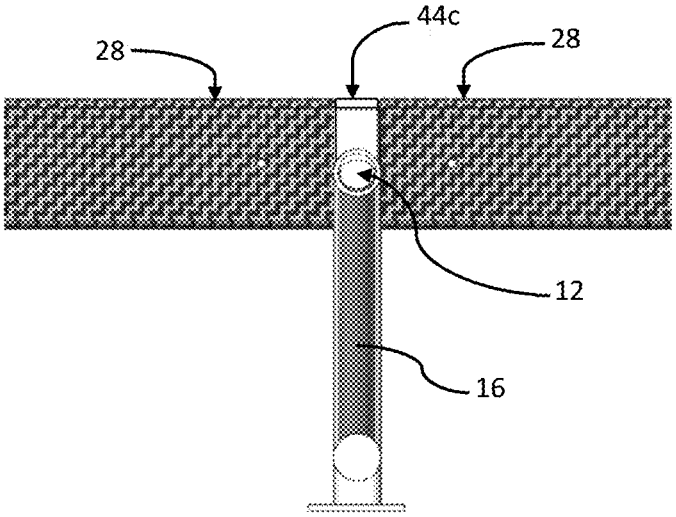
FIG. 17 is a front elevational view showing portions of beams coupled to a connector, and showing the connector disposed on the upper rail of framing members.

As noted above, and with reference to FIGS. 3 and 17, the upper rails 12 are disposed on a plane P1 that is spaced from and parallel to a plane P2 on which the exteriorly disposed surfaces of the upper walls 28 of the beam 18 and the upper region 44*c* of the central portion 44 lie when the rails 12 are disposed in the indents 50 of the connectors 20, and the beams 18 are joined to connectors 20. The resulting truss assembly formed from joined beams 18 and connectors 20 provides a coplanar and secure surface upon which a plurality of panels 22 may be readily secured (see FIGS. 1 and 5). The connectors 20 in turn are securely coupled to the framing members 10 via a snug fit between the upper rails 12 (see FIG. 12) within the indents 50 as described above. In addition, the weight and alignment of the spaced connector 20 and truss assemblies (which may each include multiple beams 18 spanning across multiple rails 12) virtually eliminates the possibility of any movement (either vertical or lateral) between the framing members 10, connectors 20 and beams 18 (forming truss assemblies), and thus the panels 22 and/or other support surface of the resulting platform structure. In this way, a remarkably stable portable flooring and/or walkway structure is provided. The resulting structure is capable of supporting substantial weight as compared to conventional systems, due in part to the high strength FRP beams and high-strength connectors. For example, exemplary platform structures including the scaffolding system as disclosed herein are capable of easily supporting more than 150 pounds per square foot.

In accordance with other embodiments, the scaffolding system may be utilized with one more beams 18 and connectors 20, in addition to one or more conventional support beams. Many conventional beams used in the scaffolding industry typically have a standardized height, e.g., such as a height of 5.5 inch. Accordingly, the preferred height of 5.5 inch of the beams 18 corresponds to the height of such conventional beams. However, it should be understood that the beams 18 may be readily configured to accommodate other standardized heights.

Figure 18:
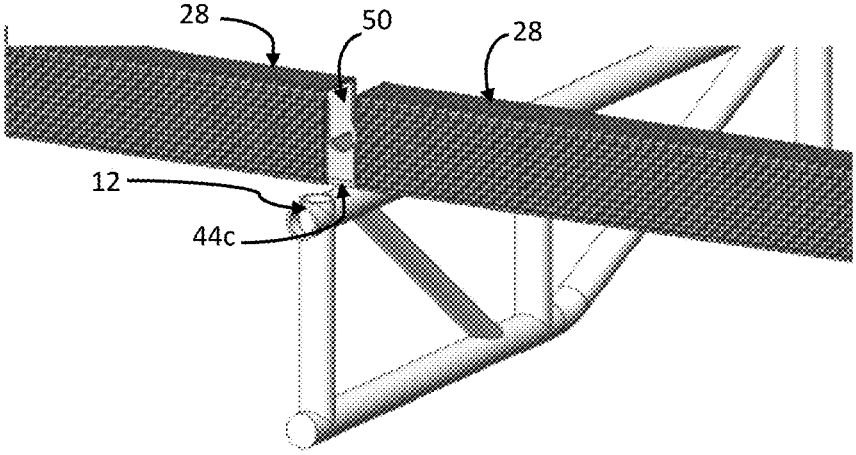
FIG. 18 is a perspective view showing portions of beams joined via a connector, and showing the connector in an inverted position relative to an upper rail of framing members.
Figure 19:
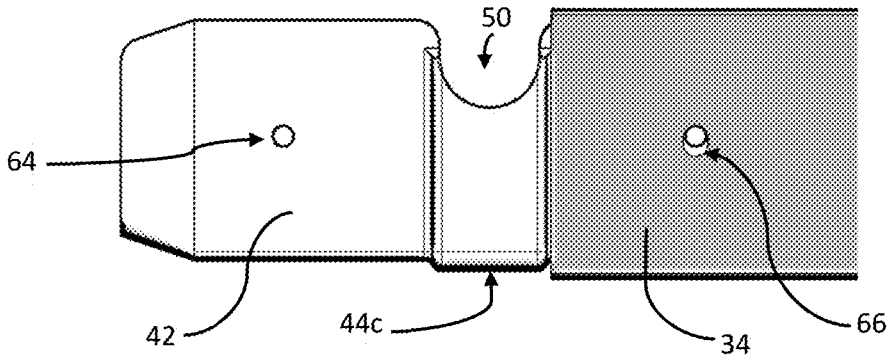
FIG. 19 is a front elevational view showing a portion of a beam coupled to a connector, and showing the connector in an inverted orientation.
Figure 20:
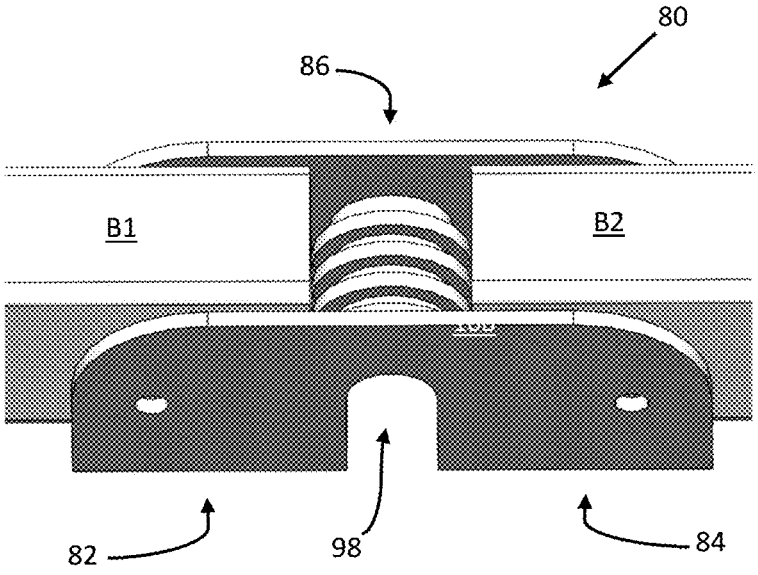
FIG. 20 is a perspective view of another connector according to disclosed embodiments, and showing portions of solid beams secured thereto.
Figure 21:
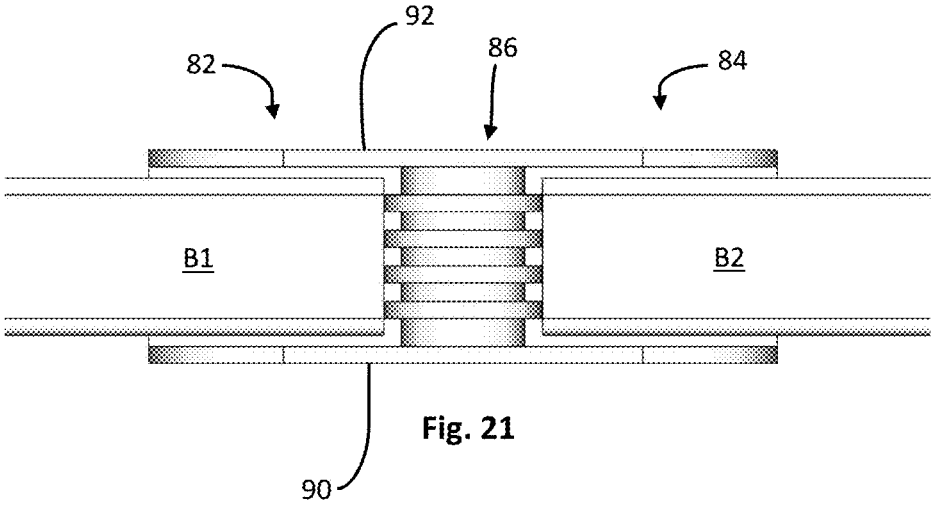
FIG. 21 is a top view of the connector and beams of FIG. 20.

As shown in FIG. 18, the orientation of the connector(s) 20 on the upper rails 12 may be inverted, so that the upper region 44*c* of the central portion 44 rests on the upper rails 12. As such, the beams 18 extend upwardly from the rails 12 by an increased height (e.g., 5.5 inch) as compared to when the upper region 44*c* is positioned upwardly relative to a support surface S, given the rails 12 are not disposed in the indents 50, which would decrease the overall distance between the plane P1 and plane P2 (see FIG. 3). Note that the holes 66 in the beams may be configured as ovals or slots to accommodate for differing orientations of the holes 62, 64 when connectors 20 are inverted, as shown in FIG. 19. Thus, the beams 18 and connectors 20 may be utilized in conjunction with conventional beams, e.g. conventional wood beams having a height of 5.5. inch.

Figure 22:
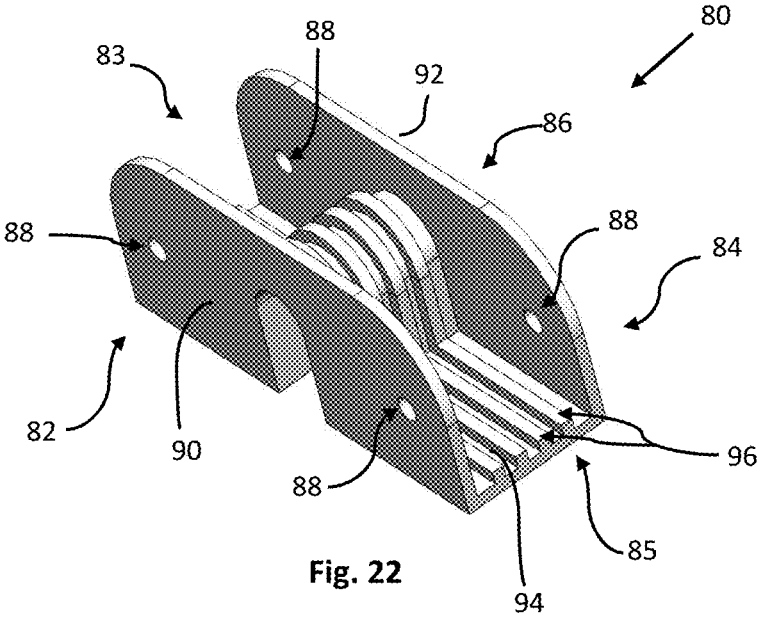
FIG. 22 is another perspective view of the connector of FIG. 20.
Figure 23:
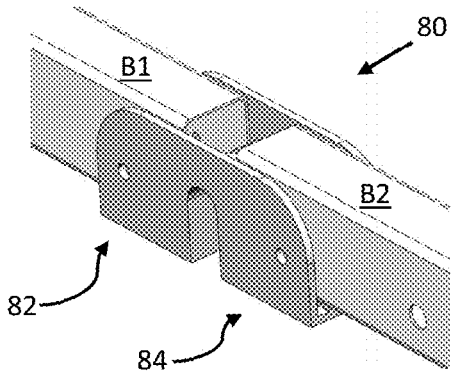
FIG. 23 is a another perspective view of the connector and beams of FIG. 20.

Also disclosed is a connector 80 suitable for use with conventional solid wood (or other material) support beams. Referring to FIGS. 20-23, connector 80 includes opposing end portions 82, 84 and a central portion 86. Longitudinally aligned ends of beams B1, B2 (e.g., wood beams) are insertable and securable in end portions 82, 84 (see FIGS. 20, 21 and 23). Each end portion 82, 84 may include holes 88 (FIG. 22) extending through first and second opposing sides 90, 92 for securing the ends of the beams B1, B2 thereto (e.g., such as via pins, bolts, screws or other suitable fasteners). The connector 80 may have a generally U-shaped configuration in cross-section (FIG. 22). Connector 80 is configured to receive the ends of beams B1, B2 in recesses 83, 85 defined by end portions 82, 84, respectively (as opposed to being inserted into a hollow tubular beam as provided with connector 20). The beams B1, B2 are received on respective bottom walls 94 of recesses 83, 85 of each of portions 82, 84, and between sides 90, 92. The connector 80 may include a plurality of support struts 96 or spacers extending outwardly from interiorly disposed surfaces sides 90, 92 and bottom walls 94 (FIG. 22). Preferably, the connector 80 is formed from a high strength polymer material, as described above.

With continued reference to FIGS. 20-23, opposing sides 90, 92 of connector 80 include a cutout or indent 98, which functions similar to indent 50 as described above. Thus, indent 98 is configured for receiving an upper rail 12 of a framing member 10. End portions 82, 84 extend outwardly from upper rail 12 when the central portion 86 is disposed on rail 12. In this way, connector 80 is maintained plumb relative to the framing and other components of the scaffolding. Panels 22 may be secured directly to connected beams B1, B2 (e.g., using screws or other fasteners), thereby forming an extremely secure support.

Figure 24:
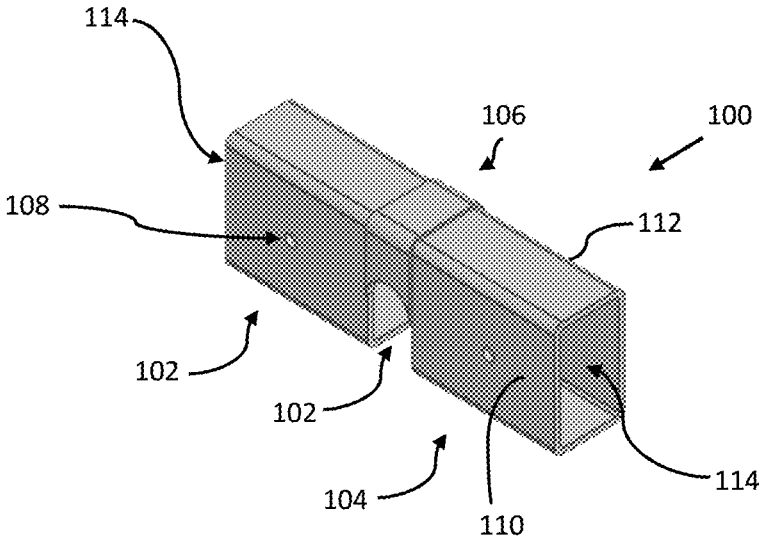
FIG. 24 is a perspective view of another connector according to disclosed embodiments.

A connector 100 according to another embodiment is illustrated in FIG. 24. Similar to connector 80, connector 100 may be used with solid wood (or other material) support beams (e.g., such as beams B1, B2). Connector 100 includes opposing end portions 102, 104 and a central portion 106. Ends of longitudinally aligned ends of beams B1, B2 (e.g., wood beams) are insertable into and securable in openings 114 in end portions 102, 104. Each end portion 102, 104 may include holes 108 extending through first and second opposing sides 110, 112 for securing the ends of the beams B1, B2 within the openings 114 and interior cavities defined by end portions 102, 104 as shown (e.g., such as via pins, bolts, screws or other suitable fasteners). The connector 100 has a tubular configuration with the openings 114 in each distal end thereof for receiving a corresponding distal end of a beam therein. Thus, connector 100 is configured to receive the ends of beams B1, B2 in end portions 102, 104 (as opposed to being inserted into a hollow tubular beam as provided with connector 20). Preferably, the connector 80 is formed from a high strength polymer material, as described above.

While the invention has been described in connection with exemplary embodiments thereof, it will be understood that it is capable of further modifications. In addition, features of one embodiment may be utilized in another embodiment. For example, the connector may include features from one or more embodiments. In addition, a T-shaped connector may be provided which includes a third receiving area (corresponding to the first or second end portions) extending outwardly from the central portion (adjacent to the indent) for securing to a third beam. Thus, this application is intended to cover any variations, uses, or adaptations of the invention following, in general, the principles of the invention and including such departures from the present disclosure as come within known or customary practice within the art to which the invention pertains and as may be applied to the features hereinbefore set forth.

What is claimed is:

1. A scaffolding system comprising:

a framing member having a first longitudinal axis and disposed on a first plane;

at least a first support beam and a second support beam; and a connector having a first end portion securable to said first support beam, a central portion, and an opposing second end portion securable to said second support beam, and said central portion comprises an upper portion and a lower portion, said lower portion comprises an indent intermediate to said first and second end portions, wherein said framing member resides within the indent;

wherein said first support beam is coupled to said second support beam via said connector so that said first and second support beams are collinearly aligned along a second longitudinal axis and disposed on a second plane vertically spaced from the first plane, wherein said first longitudinal axis is substantially perpendicular to said second longitudinal axis when said framing member resides in said indent.

2. The scaffolding system of claim 1, wherein each of said first and second support beams is configured as an elongate rectangular tube.

3. The scaffolding system of claim 2, wherein said first end portion of said connector is receivable within an opening disposed in an end of said first support beam, and said second end portion of said connector is receivable within an opening disposed in an end of said second support beam.

4. The scaffolding system of claim 3, wherein said central portion of said connector comprises a raised upper region, said raised upper region substantially coplanar with an exteriorly disposed surface of said first and/or second support beams when said connector is coupled to said first and/or second support beams.

5. The scaffolding system of claim 4, wherein said raised upper region has a thickness substantially equal to a thickness of a wall defining said first and/or second support beams.

6. The scaffolding system of claim 3, wherein at least one of said first end portion or said second end portion comprises a tapered distal end portion.

7. The scaffolding system of claim 1, wherein at least one of said first or second support beams is releasably securable to said connector via a fastener extending through correspondingly alignable openings in said first or second support beam and said connector.

8. The scaffolding system of claim 1, wherein said first and/or second support beam is formed from a fiber reinforced polymer (FRP) material.

9. The scaffolding system of claim 8, wherein said FRP material comprises a polymer matrix and reinforcing fibers.

10. The scaffolding system of claim 8, wherein said FRP material comprises one or more additives selected from the group consisting of a colorant, a lubricant, an anti-static, a heat stabilizer, an ultraviolet stabilizer, a flame retardant, a biocide, an insecticide, and an anti-corrosive agent.

11. The scaffolding system of claim 1, wherein said connector is formed from a high strength polymer material comprising nylon, high density polyethylene (HDPE), polybutylene terephthalate (PBT), high glass acrylonitrile butadiene styrene (ABS), and/or polycarbonate (PC).

12. The scaffolding system of claim 11, wherein said high strength polymer material comprises a polymer matrix and reinforcing fibers.

13. The scaffolding system of claim 11, wherein said high strength polymer material comprises one or more additives selected from the group consisting of a colorant, a lubricant, an anti-static, a heat stabilizer, an ultraviolet stabilizer, a flame retardant, a biocide, an insecticide, and/or an anti-corrosive agent.

14. The scaffolding system of claim 1, wherein said connector has a generally U-shaped configuration in cross-section.

15. The scaffolding system of claim 1, wherein said connector comprises a plurality of support struts extending between interiorly disposed surfaces of opposing sides thereof.

16. The scaffolding system of claim 1, further comprising one or more panels securable to an upper surface of said first and/or second support beams.

17. The scaffolding system of claim 1, wherein the first plane is disposed above a support surface, wherein the second plane is more vertically spaced from the support surface than the first plane.

* * * * *